United States Patent [19]

Norz et al.

[11] Patent Number: 5,001,845

[45] Date of Patent: Mar. 26, 1991

[54] CONTROL SYSTEM FOR AN INDUSTRIAL DRYER

[75] Inventors: Gerald R. Norz, New Franken; Steve J. Zagar, Green Bay; Dennis L. Hansen, DePere, all of Wis.

[73] Assignee: W.R. Grace & Co.,-Conn., New York, N.Y.

[21] Appl. No.: 395,429

[22] Filed: Aug. 17, 1989

[51] Int. Cl.[5] ..... F26B 5/04

[52] U.S. Cl. ..... 34/16; 34/23; 34/79; 34/155; 34/156; 34/36

[58] Field of Search ..... 34/23, 155, 156, 215, 34/242, 80, 79, 36, 37, 16

[56] References Cited

U.S. PATENT DOCUMENTS

| | | | |
|---|---|---|---|
| 3,728,074 | 4/1973 | Victor . | |
| 4,012,847 | 3/1977 | Rand . | |
| 4,128,947 | 12/1978 | Jackson . | |
| 4,150,494 | 4/1979 | Rothchild | 34/242 X |
| 4,321,757 | 3/1982 | Van Der Blom | 34/242 X |
| 4,464,845 | 8/1984 | Bubelo et al. . | |
| 4,513,590 | 4/1985 | Fine . | |
| 4,530,165 | 7/1985 | Tiedemann . | |
| 4,715,965 | 12/1987 | Sigerson et al. | 34/79 X |
| 4,729,177 | 3/1988 | Vecchia . | |
| 4,780,965 | 11/1988 | Grafen et al. | 34/79 X |
| 4,823,479 | 4/1989 | Dornier et al. . | |
| 4,844,743 | 7/1989 | Koblenzer et al. . | |

*Primary Examiner*—Henry A. Bennet

[57] ABSTRACT

A control system for an industrial dryer used to remove a flammable solvent or vapors from a traveling web of material or the dryer. The dryer consists of a chamber which is preferably a large metallic cylinder through which the web of material moves longitudinally. Seals in the metallic cylinder at the points of entry and exit of the traveling web permit the control system to maintain the desired environment under controlled pressure within the metallic cylinder. The web of material travels successively through one or more zones within the metallic cylinder. At each zone, the web of material is exposed to a pressurized atmosphere which may be at increasingly higher temperatures. The solvent is recovered from the pressurized atmosphere by rapid cooling, membrane separation or absorption. Sensors within each zone measure the oxygen content of the pressurized atmosphere. If the oxygen content exceeds a given threshold, pressurized nitrogen or other inert gas is added. Through the use of a carbon bed at the last zone, the pressurized atmosphere from that zone is rendered sufficiently free of solvent to be exhausted to the air or a nitrogen recovery unit, thereby maintaining the desired overall pressure within the metallic cylinder.

30 Claims, 6 Drawing Sheets

SPENT PLANT WATER SUPPLY

298
WATER RETURN
96
60
CARBON BED
62
294
70% EFF.
290
292
286
77
288
300
302
HEXANE
74
76
306
78
304
STEAM SUPPLY
N2
310
308
282
CONDENSATE RETURN
276
274
284
278
76
280
272
18
58a
58b
268
320
35
PURGE AIR
270
322
318
314
262
258
12
264
260
12
316
312

CONTROL SYSTEM FOR AN INDUSTRIAL DRYER

CROSS REFERENCE TO CO-PENDING APPLICATION

This application is related to co-pending U.S. Pat. No. application Ser. No. 07/395,440, filed Aug. 17, 1989, entitled "Zoned Cylindrical Dryer", assigned to the same assignee.

Background of the Invention

1. Field of the Invention

The present invention relates generally to industrial dryers, and more particularly, relates to industrial dryers employing a controlled environment for the recovery of flammable, valuable or any other solvents.

2. Background of the Prior Art

It is known in the art that processes which involve flammable fluids must often be accomplished in sealed chambers. It is particularly important to protect operators and other workers in the area from dangers associated with inhaling certain solvents and from fire. U.S. Pat. No. 4,826,707 issued to Schwarz et al. on May 2, 1989, shows such a sealed chamber. The process taught by Schwarz et al. is the coating of a web of material while cooling the material to avoid structural damage. The environment of the chamber of Schwarz et al. is easily controlled because the entire web of material undergoing processing is contained within the sealed chamber.

At times, however, it is desirable to process a continuous traveling web of material of considerably greater volume than can be practically contained within the sealed chamber. Therefore, the continuous web of material must travel through the chamber making it difficult to control the atmosphere within the chamber. The most common technique is through the use of an inert gas to backfill the chamber at a pressure which is controlled relative to atmospheric pressure. This permits the maximum control of the environment within the chamber.

When the process involves the release of a flammable or other fluid, such as the removal of a flammable solvent, great care must be exercised in maintaining a low oxygen level within the sealed chamber. A common prior art technique is to purge the entire chamber when the oxygen level exceeds a predetermined threshold level. This often results in unacceptable down time of the process and unacceptable waste of the inert gas used to backfill the chamber. Such purging may itself present a safety risk because the contents of the chamber often cannot simply be vented to the air.

The present invention overcomes the disadvantages of the prior art by providing a control system for a dryer.

SUMMARY OF THE INVENTION

The present invention utilizes a substantially sealed chamber having at least one and preferably a plurality of drying zones. Each successive drying zone removes additional solvent and may operate at increasingly higher temperatures. A continuous traveling web of material enters and exits the substantially sealed chamber through optional pressure seals.

Oxygen sensors are strategically positioned within each of the drying zones to monitor the oxygen level within the corresponding drying zone. Upon approaching a predetermined oxygen level threshold, nitrogen is automatically added to the environment of the drying zone to maintain the oxygen at a safe level.

The last drying zone utilizes a carbon bed to filter the environment following condensation. The output of the carbon bed contains so little solvent that it may be safely vented directly to the air or to a nitrogen recovery unit. This venting may become necessary to maintain the overall pressure of the sealed cylinder within a predetermined range, as nitrogen is added to control the oxygen level.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
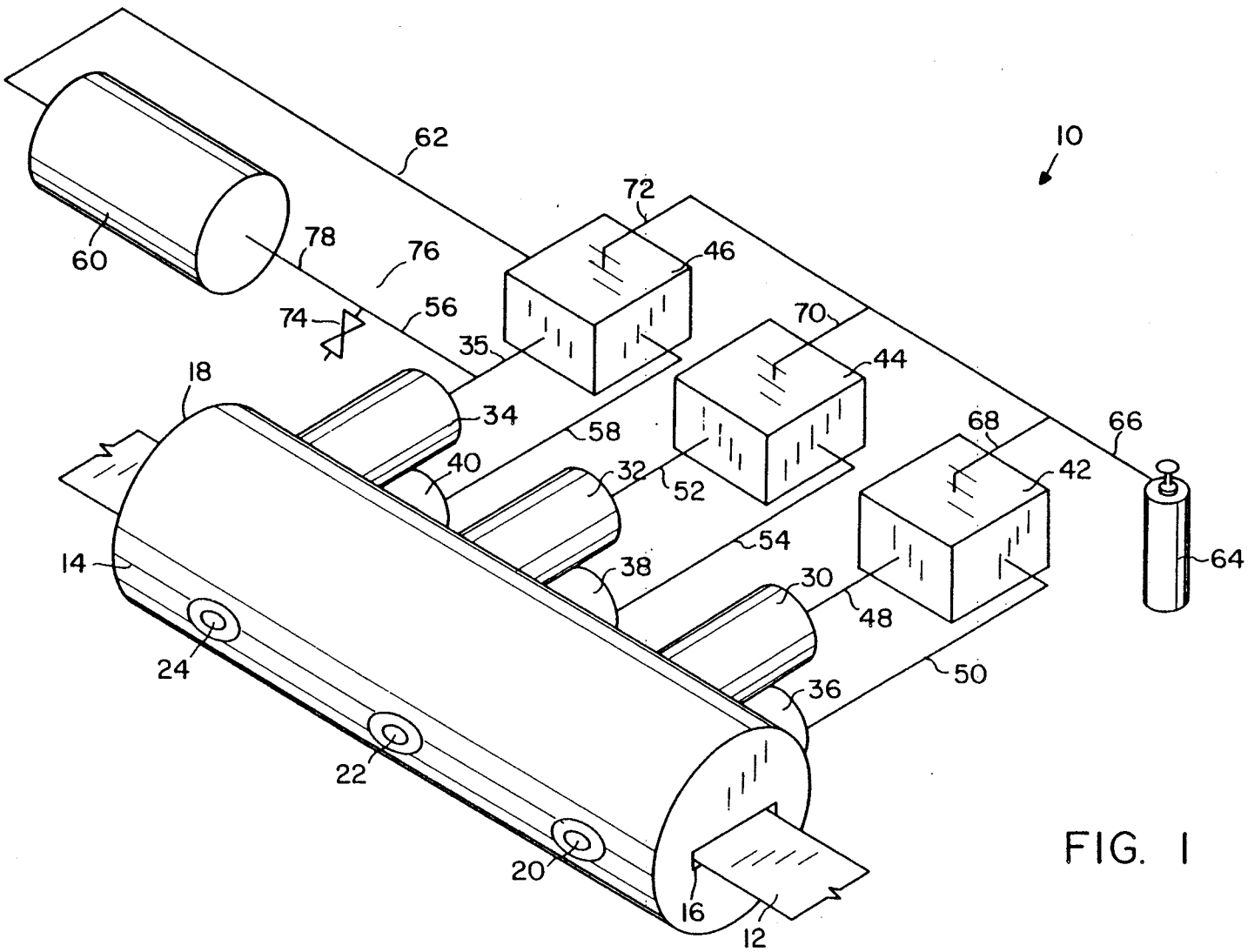
FIG. 1 is a perspective view of an industrial dryer in operation employing the control system of the present invention.

FIG. 1 is a perspective plan view of an industrial dryer 10 employing the control system of the present invention. Industrial dryer 10 is employed to remove a solvent such as hexane from the material of traveling web 12. Traveling web 12 enters a substantially sealed cylinder 14 at an optional entry seal 16 and exits substantially sealed cylinder 14 at an optional exit seal 18.

In one preferred mode, industrial dryer 10 is cylindrical in shape, although the control system will operate with dryers of other geometrical shapes. Preferably, the industrial dryer 10 has three drying zones, although those of skill in the art will be able to apply the teachings found herein to industrial dryers having any different number of drying zones. Each of the three drying zones is accessed by and viewed through a different corresponding windowed door. Door 20 corresponds to drying zone one. Similarly, door 22 corresponds to drying zone two, and door 24 corresponds to drying zone three.

Drying zone one (DZ1) receives treated, pressurized atmosphere via duct 30. This treated, pressurized atmosphere is directed by air bars to the material of traveling web 12 as it passes drying zone one. Duct 36 evacuates atmosphere from drying zone one and returns it to condensing unit 42. Through the use of heating and cooling coils, condensing unit 42 condenses the hexane solvent and returns it to the recovery area not illustrated for purposes of brevity. The remaining atmosphere is again pressurized and returned to drying zone one via path 48 and duct 30.

Similarly, drying zone two (DZ2) receives treated, pressurized atmosphere via path 52 and duct 32 from condensing unit 44. Drying zone two is exhausted by duct 38 and path 54.

The exhaust from drying zone three (DZ3) is channeled via duct 40 and path 58 to condensing unit 46. Following condensation, the atmosphere is sent via path 62 to carbon bed 60 for filtering. The carbon bed also provides for lowering the level of solvent in the atmosphere for that zone below what is attainable by condensing systems. More than one carbon bed may be desirable. The carbon bed can be cycled depending upon the parameters of operation. After filtering the treated, pressurized atmosphere is returned to drying zone three via paths 56 and 78 and duct 34. However, after filtering, the output of carbon bed 60 is sufficiently free of solvent to be vented directly to the air or routed to a nitrogen recovery unit. This is done by control valve 76 and vent stub 74 whenever the system determines that venting is necessary to maintain the overall pressure of substantially sealed cylinder 14 within the predetermined limits. Operation of this venting procedure is explained in further detail below.

Pressurized nitrogen is stored in storage tank 64. It may be supplied via path 66 to drying zone one, two, and three via paths 68, 70, and 72, respectively. An oxygen sensor within each of the three zones and any other of the process locations constantly monitor the oxygen level within the corresponding drying zone. Whenever the oxygen level exceeds a predetermined level, nitrogen is automatically added to that zone to maintain its environment at a safe level. Addition of nitrogen to control oxygen level is also explained in further detail below.

Figure 2:
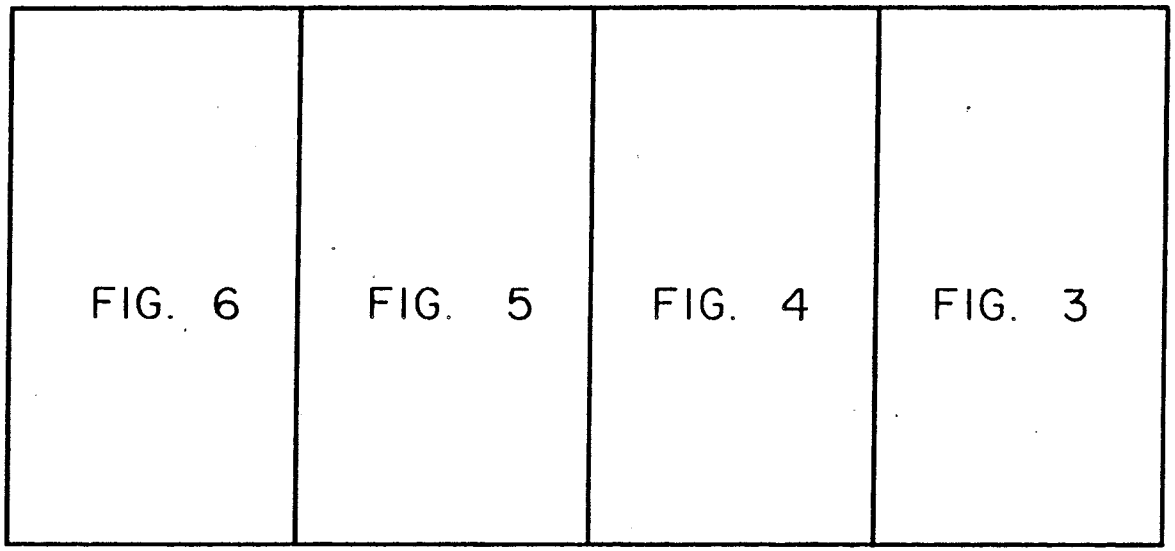
FIG. 2 shows the relationship of the detailed schematic diagrams of FIGS. 3–6 with respect to each other.

FIG. 2 shows the relationship of FIGS. 3–6 with respect to each other, which present a detailed schematic diagram for the operation of the control system of the present invention for a dryer.

Figure 3:
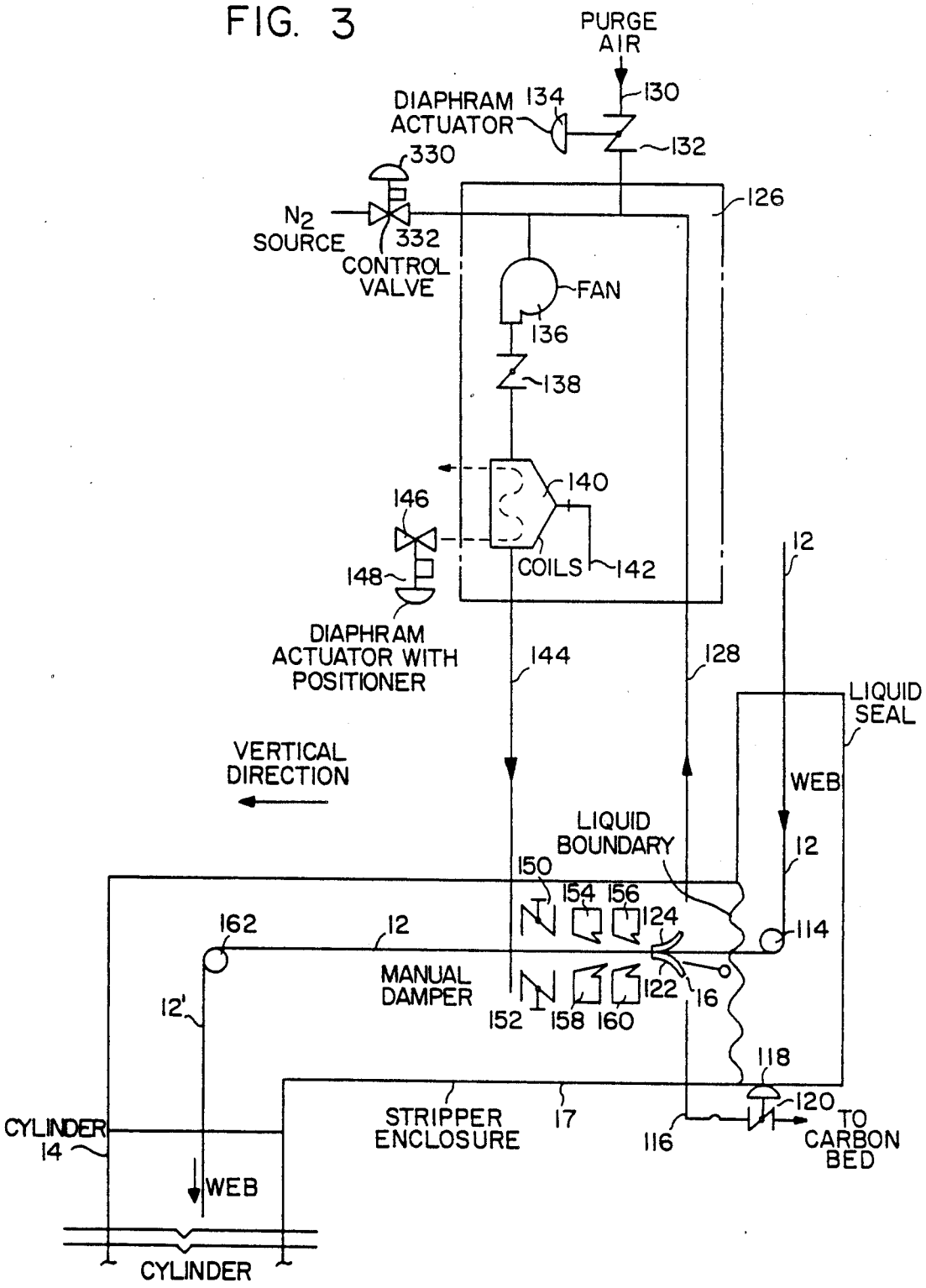
FIG. 3 is a schematic diagram of the control system for a stripper system attached to the exit of a liquid seal and before the entry of the cylinder entry seal.

FIG. 3 is a schematic diagram of a stripper system attached to cylinder 14 and after the liquid seal. Notice that the symbology used is common to FIGS. 3–6. Symbol 100 represents a control valve. Symbol 102 represents a fan. Symbol 104 represents a manually operated damper. Symbols 106 and 108 represent diaphragm actuators without and with a positioner, respectively. Symbol 110 represents a set of coils, and symbol 112 represents a heat exchanger.

Traveling web 12 is shown schematically entering the substantially sealed cylinder 14 illustrated in FIG. 1. The traveling web 12 is directionally positioned by idler 114. Optional entry seal 16 may be vented via path 116 to carbon bed 60 as necessary. Venting is automatically controlled by diaphragm positioned 118 and damper 120.

Conformable sealing lips 122 and 124 seal about traveling web 12. Enclosure 17 is pressurized by precondensing unit 126. Atmosphere is exhausted from enclosure 17 via path 128 to precondensing unit 126. Enclosure 17 may be purged with purge air via path 130 as needed. This process may be readily controlled manually or automatically by diaphragm actuator 134 and damper 132. The purge air is added to path 128 where it is maxed and pressurized by fan 136 to the degree shown in the diagram. Coarse manual adjustment of the output of fan 136 is made at manual damper 138. The level of oxygen is constantly monitored for safety. Whenever the level exceeds a range of 2–3 percent, preferably fixed percent by volume, diaphragm actuator 330 opens valve 332 to permit input of pressurized nitrogen or inert gas from a storage tank 64.

Coil 140 slightly cools the atmosphere thereby condensing a small amount of the solvent at solvent recovery 142. The cooled atmosphere is returned to enclosure 17 via path 144. Water flow in coil 140 is controlled automatically by diaphragm actuator 148 operating-upon valve 146. Temperature control is easily maintained using a temperature sensor not illustrated of the sake of brevity.

The treated, pressurized atmosphere is returned to enclosure 17 via path 144 and directed by vents 154 and 156 to one side of traveling web 12 and by vents 158 and 160 to the other side. Coarse manual control of the atmosphere streams is afforded by annual dampers 150 and 152. Before exiting from enclosure 17, traveling web 12 passes around idler 162.

Figure 4:
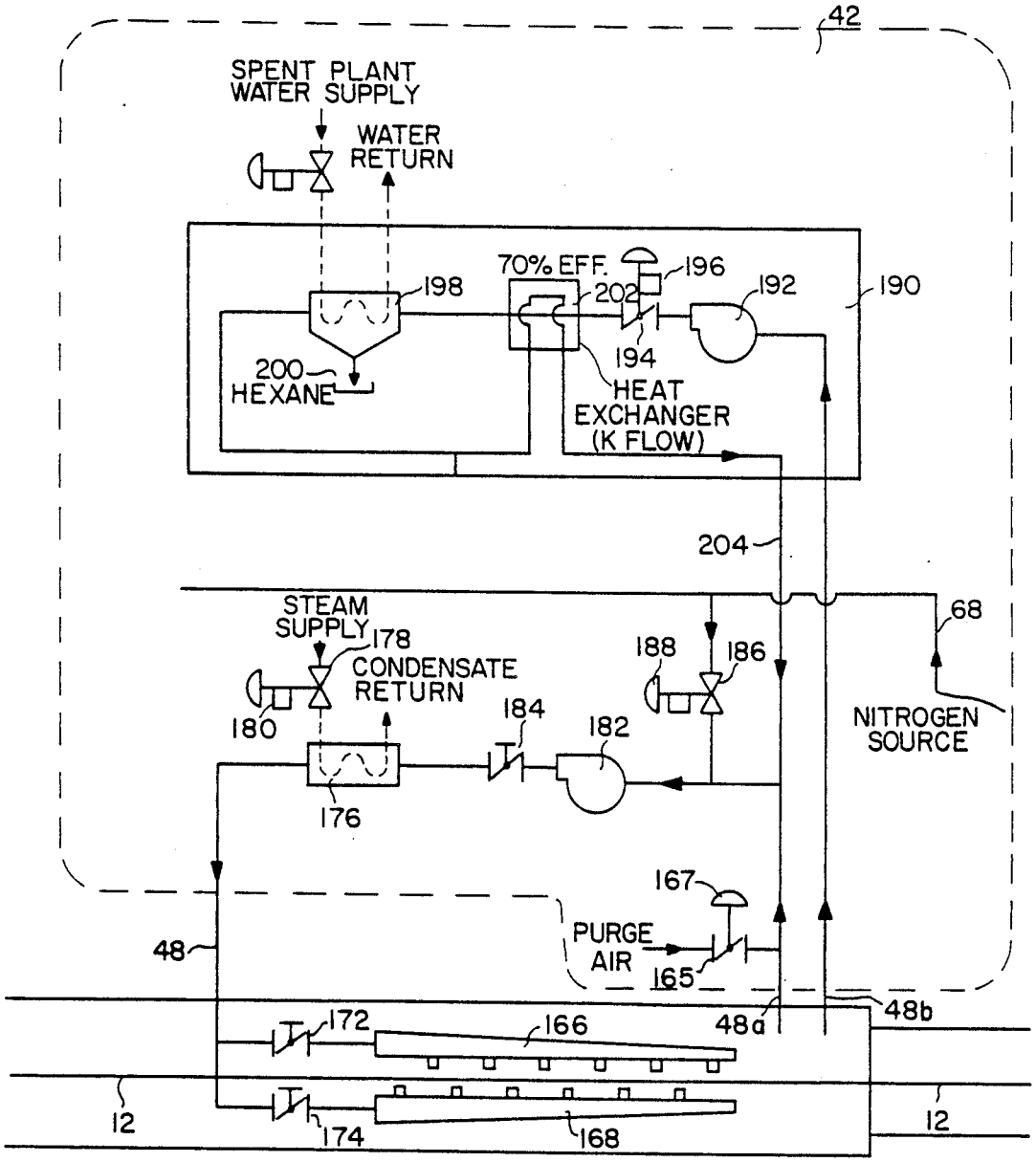
FIG. 4 is a schematic diagram of the control system for drying zone one.

FIG. 4 is a schematic diagram of drying zone one (DZ1) wherein the symbols used are defined in FIG. 3. Traveling web 12 passes through drying zone one buy passing between air bars 166 and 168. Other suitable support structure such as rollers can be used in lieu of the air bars. A description of the operation of suitable air bars can be found in U.S. Pat. No. 4,425,719 issued to Klein et al. on Jan. 17, 1984. Input atmosphere to air bars 166 and 168 is received via path 48. Coarse adjustment of the atmosphere streams may be made by manual dampers 172 and 174. The atmosphere transmitted via path 48 is heated by coil 176 as shown . Temperature control of the atmosphere is accomplished by controlling ht steam input with diaphragm actuator 180 operation upon steam value 178. The air is pressurized by fan 182 with coarse flow adjustment made by manual damper 184.

The enclosure oxygen content of the atmosphere is continually measured. Measurement is accomplished by example with an available monitor such as by Beckman Instruments, Inc. Model 755 which determines oxygen content in the range of 0–25% by volume. Ideally,. the oxygen level should not exceed 9–12% by volume. Therefore, fi the measured content exceeds a fixed set point, for example five percent by volume, nitrogen is added from path 68 (see also FIG. 1). The automatic addition of nitrogen is accomplished by valve 186 and actuator 188.

All of the atmosphere exhausted from drying zone via path 50 (i.e. 50A and 50B) is eventually heated by steam coils 176 before being returned to drying zone one. Some of the atmosphere, however, is sent via path 50B to cooling unit 190 wherein solvent is actually condensed form the atmosphere. Fan 192 propels the atmospheres through cooling unit 190. Damper 194 as controlled by diaphragm actuator 196 determines the rate of atmosphere flow through cooling unit 190.

Using water or other coolant flow through cooling coils 198, the atmosphere is chilled causing condensation of some of the solvent has shown. Recovery of the solvent is made via path 200. Because the atmosphere which exits cooling coils 198 will simply be heated again before returning to drying zone one, it is passed through heat exchanger 202 to remove some of the heat from the atmosphere which is yet to be chilled. the treated atmosphere is the returned via path 204 to be pressurized by fan 182 and heated by coils 176. Drying zone one may be purged with air through damper 165 controlled by diaphragm actuator 167 as needed.

Figure 5:
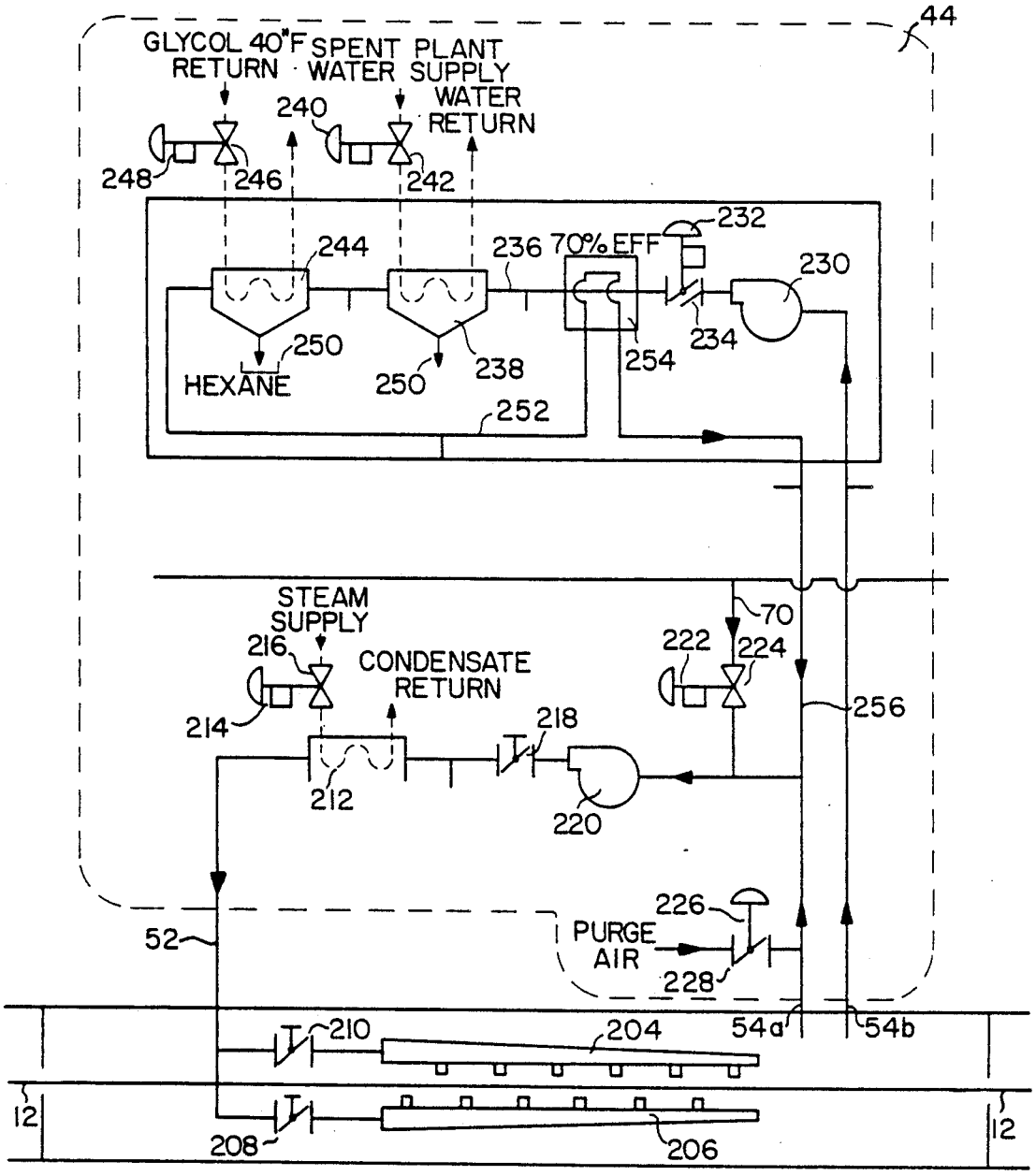
FIG. 5 is a schematic diagram of the control system for drying zone two; and, FIG. 6 is a schematic diagram of the control system for drying zone three and the cylinder exit seal.

FIG. 5 is a schematic diagram of drying zone two (DZ2). As can be seen, it is organized and functions in a similar manner to drying zone one but may operate within a different temperature range. Its function is yet additional solvent from the traveling web material.

Traveling web 12 is borne through drying zone two between air bars 204 and 206. Treated and pressurized atmosphere is provided to air bars 204 and 206 by path 52. Coarse adjustment of the atmosphere streams is provided by manual dampers 208 and 210.

The atmosphere supplied via path 52 is heated by steam coils 212. Atmosphere temperature is controlled by regulating the steam input to coils 212 with stream valve 216 as operated by diaphragm actuator 214. The supply atmosphere is pressurized by fan 220. Coarse control of overall atmosphere supply is provided by manual damper 218.

Atmosphere which is exhausted from drying zone two leaves via path 54 (i.e. paths 54A and 54B). Path 54A simply recycles the atmosphere by routing it through fan 220 and steam coils 212. Path 54B, however, routes some of the atmosphere to a cooling unit for additional condensation of solvent. Fan 230 moves the atmosphere through the cooling unit. Damper 234 as controlled by diaphragm actuator 232 regulates the overall amount of atmosphere flow through the cooling unit.

Condensation occurs at coils 238 and 244. As shown the atmosphere is first presented to coil 238 which is water or coolant cooled under control of valve 242 and diaphragm actuator 240. coil 244 operates at a much lower temperature using glycol as the cooling fluid as controlled by valve 246 and diaphragm actuator 248. The condensed solvent is returned to the process using recovery paths 250.

The output of coil 244 must against be heated before returning to drying zone two. Therefore, it is routed through that exchanger 254 to remove heat from the incoming atmosphere to improve efficiency. The treated atmosphere is then turned to be heated via path 256.

As with drying zone one, the level of oxygen is constantly monitored for safety. Whenever the level exceeds a fixed point, for example five percent by volume, diaphragm actuator 222 opens vale 224 to permit input of pressurized nitrogen from the storage tank 64 (see also FIG. 1). The preferred component is the same as in drying zone one.

Figure 6:
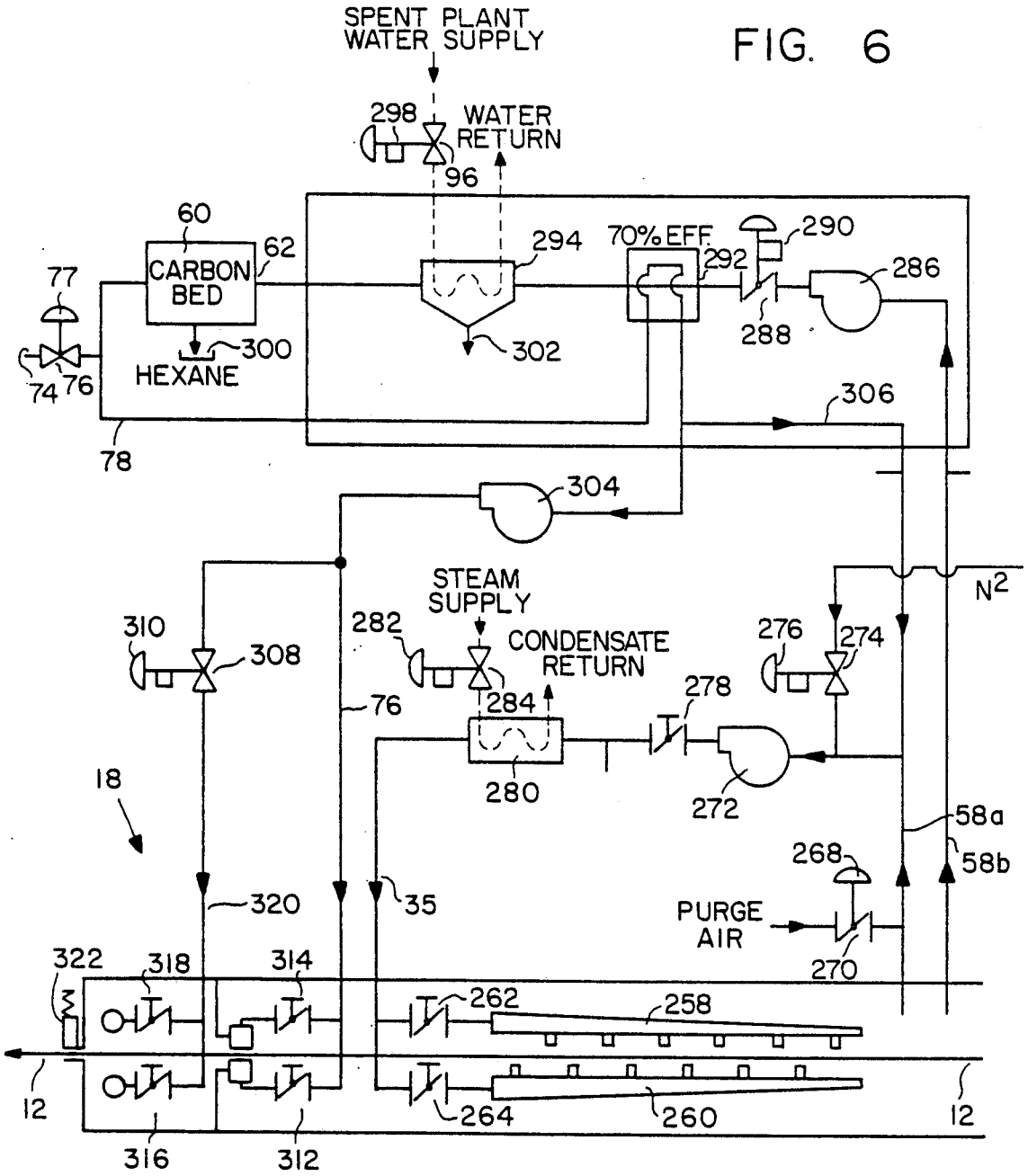

FIG. 6 is a schematic diagram of drying zone three (DZ3) as coupled to optional exit seal 18. Traveling web 12 passes through drying zone three between air bars 258 and 260. These air bars are pressurized from the atmosphere stream arriving via path 35. Coarse control of the atmosphere flow is provided by manual dampers 262 nd 264. The atmosphere stream is pressurized by fan 272 and heated by steam coil 280. Overall flow of atmosphere through steam coil 280 is provided by manual damper 278. Temperature is regulated by steam valve 284 as controlled by diaphragm actuator 282.

Atmosphere is exhausted from drying zone three via path 58 comprising paths 58A and 58B. The atmosphere exhausted by path 58A is repressurized and heated as explained above. Atmosphere exhausted via path 58B is sent for additional condensation of solvent.

Fan 286 moves the atmosphere through the cooling system of drying zone three. The overall volume of atmosphere is controlled by damper 288 and regulated by diaphragm actuator 290. Condensation is accomplished at coil 294. It is water or coolant cooled with the temperature regulated by valve 296 as controlled by diaphragm actuator 298. Condensed solvent is recovered by return 302.

The output of coil 294 has had all of the solvent removed which can be efficiently accomplished using condensation. Ye the output of coil 294 contains too much solvent to be safely vented to the air. This atmosphere is then sent via path 62 to carbon bed 60. This is a standard, commercially available filter system such as VIC Series 500 or Series 900 available from Vic Manufacturing Company of Minneapolis, Minn.

Absorption structure system including carbon bed 60 removes further solvent from the atmosphere which is recovered by return 300. The output of carbon bed 60 contains so little solvent that it can be vented directly to he air. This venting is automatically performed by valve 76 as controlled by diaphragm actuator 77. The vented atmosphere exits via vent stub 74. Venting is used to maintain the overall internal pressure of cylinder 14 within the desired range. Pressure is increased, of course, whenever pressurized nitrogen is added to reduce the internal oxygen to the predetermined safe limits described above.

The output of carbon bed 60 is returned to drying zone three via path 78. Because the atmosphere must be reheated before being returned to the drying zone, its is routed through heat exchanger 292 to absorb heat for the incoming atmosphere and thereby improve overall efficiency. The atmosphere which is returned to drying zone three proceeds via path 306.

A portion of the output of carbon bed 60 is used to pressurized optional exit seal 18. It is routed via path 76 after being pressurized by fan 304. Atmosphere flow to optional exit seal 18 is regulated by manual dampers 312 and 314. Pressurized nitrogen or a portion of the output of the carbon bed may also be added via path 320. Flow of nitrogen or other inert gas is controlled by valve 308 and diaphragm actuator 310. Coarse adjustment is provided by manual dampers 316 and 318. Spring loaded exit door 322 is the primary mechanical seal of optional exit seal 18.

As in drying zones one and two, oxygen level is constantly monitored for safety. Should the oxygen level exceed a fixed set, for example and for purposes of illustration only and not to be construed as limiting five percent by volume, pressurized nitrogen is automatically added by val e 274 as controlled by diaphragm actuator 276. The preferred component is the same as in drying zones one and two.

MODE OF OPERATION

The detailed description of the preferred embodiments describes the electromechanical operation of the control system for a dryer drying a traveling web of material. While a plurality of air bars are illustrated for flotation of the web in the cylinder, other suitable support structure can be utilized such as rollers.

ALTERNATIVE EMBODIMENT

A description of an alternative embodiment for a two zone dryer without a carbon bed is set forth in Appendix 1 as attached hereto and incorporated herein.

Having thus described the preferred embodiment of the present invention, those of skill in the art will be readily able to apply the teachings found herein to various other embodiments without departing from the scope of the claims hereto attached. In the event of more than one zone, any number of zones can be utilized in any configuration according to the teachings of this disclosure.

We claim:

1. Process for controlling the atmosphere of an industrial dryer comprising the steps of:
   a. measuring the oxygen level within said atmosphere of said industrial dryer;
   b. adding a pressurized bas to dilute said oxygen level within said atmosphere of said industrial dryer whenever said oxygen level exceeds a predetermined threshold;
   c. purifying said atmosphere of said industrial dryer such that it may be safely released;
   d. measuring pressure of said atmosphere of said industrial dryer; and,
   e. releasing a portion of said atmosphere after said purifying step to maintain the pressure of said atmosphere of said industrial dryer below a predetermined threshold.

2. Process according to claim 1 wherein said purifying step comprises condensation of solvent vapor within said atmosphere of said industrial dryer.

3. Process according to claim 1 wherein said purifying step further comprises filtering of said atmosphere of said industrial dryer with a carbon bed.

4. Process according to claim 2 wherein said purifying step further comprises filtering of said atmosphere of said industrial dryer with a carbon bed.

5. Process according to claim 3 comprising the step of pressurizing a seal with the output of carbon bed.

6. Process according to claim 3 wherein said seal is an entrance seal.

7. Process according to claim 3 wherein said seal is an exit seal.

8. In combination, an inert gas dryer and a control system comprising:
   a. a sealed housing;
   b. means within a sealed housing for propelling a drying gas against said traveling web of material;
   c. means responsively coupled to said drying gas for determining that the composition of said drying gas has a safe composition;
   d. means responsively coupled to said drying gas and said determining means for diluting said drying gas with an inert gas whenever said determining means determines that said composition of said drying gas has an unsafe composition;
   e. means within said sealed housing and responsively coupled to said drying gas for purifying said drying gas to a degree necessary to vent said purified drying gas to the atmosphere; and,
   f. means within said sealed housing and responsively coupled to said purifying means for venting some of said purified drying gas to the atmosphere to maintain the pressure within said sealed housing below a predetermined threshold.

9. In combination, an inert gas dryer and a control system comprising:
   a. a sealed housing;
   b. an optional entry seal attached to said sealed housing for admitting a traveling web of material;
   c. an exit seal attached to said sealed housing for permitting a traveling web of material to exit said sealed housing;
   d. means within said sealed housing for propelling a drying gas against a traveling web of material;
   e. means responsively coupled to said drying gas for determining that the composition of said drying as has safe composition;
   f. means responsively coupled to said drying gas and said determining means for diluting said drying gas with an inert gas whenever said determining means determines that said composition of said drying gas has an unsafe composition;
   g. means within said sealed housing and responsively coupled to said drying gas for purifying said drying gas to a degree necessary to vent said purified drying gas to the atmosphere; and,
   h. means within said sealed housing and responsively coupled to said purifying means for venting some of said purified drying gas to the atmosphere to maintain the pressure within said sealed housing below a predetermined threshold.

10. The combination of claim 9 wherein said purifying means further comprises means for condensing vapor of a solvent contained within said drying air.

11. The combination of claim 9 wherein said purifying means further comprises a carbon bed.

12. The combination of claim 10 wherein said purifying means further comprises a carbon bed.

13. The combination of claim 5 including a mechanical door after said exit seal.

14. A method of drying a substrate comprising:
   a. driving said substrate through a dryer having at least two drying zones;
   b. propelling a drying gas in each drying zone against at least one surface of said substrate to evaporate solvent therefrom;
   c. measuring the oxygen concentration in each drying zone and comparing the measured value to a predetermined concentration;
   d. adding a gas to a drying zone when said measure oxygen concentration exceeds said predetermined concentration to dilute the oxygen concentration;
   e. purifying the atmosphere of each drying zone by separately cooling at least a portion thereof to condense solvent vapor within said atmosphere;
   f. recycling the purified atmosphere to each respective drying zone;
   g. further purifying the atmosphere in the second or subsequent drying zone by passing it through absorption means;
   h. measuring pressure of said purified atmosphere; and,
   i. purging at least a portion of the purified atmosphere from step g to the ambient to maintain said pressure within predetermined limits.

15. A method according to claim 14 wherein each drying zone is maintained at a positive pressure.

16. A method according to claim 14 wherein the gas added to dilute the oxygen concentration is inert to the dryer atmosphere.

17. A method according to claim 16 wherein the inert gas comprises nitrogen.

18. A method according to claim 14 wherein said recycled purified atmosphere is heated prior to entering each prying zone.

19. A method according to claim 18 wherein at least some of said heating is accomplished by heat exchange with the drying zone atmosphere.

20. A method according to claim 14 further comprising drying said substrate through an optional entry seal.

21. A method according to claim 14 further comprising driving said substrate through an optional exit seal.

22. A method according to claim 14 wherein the solvent comprises hexane.

23. A method according to claim 22 wherein the absorption means comprises a carbon bed.

24. A method according to claim 23 of pressurizing an optional exit seal with the output of said carbon bed.

25. A method according to claim 14 wherein each drying zone is maintained at a fixed pressure relative to atmosphere.

26. Process for controlling the atmosphere of an industrial dryer comprising the steps of:

a. measuring the oxygen level within said atmosphere of said industrial dryer;

adding a pressurized gas to dilute said oxygen level within said atmosphere of said industrial dryer whenever said oxygen level exceeds a predetermined threshold;

c. purifying said atmosphere of said industrial dryer such that it may be safely released;

d. filtering of said atmosphere of said industrial dryer with a carbon bed;

e. pressurizing a seal with the output of carbon bed; and, f. releasing as portion of said atmosphere after said purifying step to maintain the pressure of said atmosphere of said industrial dryer below a predetermined threshold.

27. In combination, an inert gas dryer and a control system comprising:

a. a sealed housing;

b. an entry seal attached to said sealed housing for admitting a traveling web of material;

c. an exit seal attached to said sealed housing for permitting a traveling web of material to exit said sealed housing;

d. a mechanical door after said exit seal;

e. means within said sealed housing for propelling a drying gas against said traveling web of material;

f. means responsively coupled to said drying gas for determining that the composition of said drying gas has a safe composition;

g. means responsively coupled to said drying gas and said determining means for diluting said drying gas with an inert gas whenever said determining means determines that said composition of said drying gas has an unsafe composition;

h. means with said sealed housing and responsively coupled to said drying gas for purifying said drying gas to a degree necessary to vent said purified drying gas to the atmosphere; and, i. means within said sealed housing and responsively coupled to said purifying means for venting some of said purified drying gas to the atmosphere to maintain the pressure within said sealed housing below a predetermined threshold.

28. A method of drying a substrate comprising:

a. driving said substrate through a dryer having at least two drying zones;

b. propelling a drying gas in each drying zone against at least one surface of said substrate to evaporate solvent therefrom;

c. measuring the oxygen concentration in each drying zone and comparing the measured value to a predetermined concentration;

d. adding a gas to a drying zone when said measured oxygen concentration exceeds said predetermined concentration to dilute the oxygen concentration;

e. purifying the atmosphere of each drying zone by separately cooling at least a portion thereof to condense solvent vapor within said atmosphere;

f. recycling the purified atmosphere to each respective drying zone;

g. further purifying the atmosphere in the second or subsequent drying zone by passing it through a carbon bed;

h. purging at least a portion of the purified atmosphere from step g to ambient; and, i. pressurizing an exit seal with the output from the carbon bed.

29. In combination, an inert gas dryer and a control system comprising:

a. a sealed housing with an external means and an exit means for a traveling web of material;

b. means within said baled housing for propelling a drying gas against said traveling web of material;

c. means responsively coupled to said drying gas for determining that the composition of said drying gas has a safe composition;

d. means responsively coupled to said drying gas and said determining means for diluting said drying gas with an inert gas whenever said determining means determines that said composition of said drying gas has an unsafe composition;

e. means within said sealed housing and responsively coupled to said drying gas for purifying said drying gas to a degree necessary to vent said purified drying gas to the atmosphere; and, f. means within said sealed housing and responsively coupled to said purifying means for venting a portion of said purified drying gas to the atmosphere to maintain the pressure within said sealed housing below a predetermined threshold.

30. In combination, an inert gas dryer and a control system comprising:

a. a sealed housing;

b. an entry seal attached to said sealed housing for admitting a traveling web of material;

c. an exit seal attached to said sealed housing for permitting said traveling web of material to exit said sealed housing;

d. means within said sealed housing for propelling a drying gas against said traveling web of material;

e. means responsively coupled to said drying gas for determining that the composition of said drying gas has a safe composition;

f. means responsively coupled to said drying gas and said determining means for diluting said drying gas with an inert gas whenever said determining means determines that said composition of said drying gas has an unsafe composition;

g. means within said sealed housing and responsively coupled to said drying gas for purifying said drying gas to a degree necessary to vent said purified drying gas to the atmosphere; and, h. means within said sealed housing and responsively coupled to said purifying means for venting some of said purified drying gas to the atmosphere to maintain the pressure within said sealed housing below a predetermined threshold level.

* * * * *